US009763839B2

(12) United States Patent
Morris et al.

(10) Patent No.: US 9,763,839 B2
(45) Date of Patent: Sep. 19, 2017

(54) WALKER STANDING AID ACCESSORY

(71) Applicants: Gary Dempsey Morris, Paris, TN (US); Nancy Elaine Moore-Morris, Paris, TN (US)

(72) Inventors: Gary Dempsey Morris, Paris, TN (US); Nancy Elaine Moore-Morris, Paris, TN (US)

(73) Assignee: GANM, LLC, Paris, TN (US)

( * ) Notice: Subject to any disclaimer, the term of this patent is extended or adjusted under 35 U.S.C. 154(b) by 167 days.

(21) Appl. No.: 14/756,038

(22) Filed: Jul. 24, 2015

(65) Prior Publication Data

US 2017/0020764 A1 Jan. 26, 2017

(51) Int. Cl.

| | |
|---|---|
| ***A61G 5/14*** | (2006.01) |
| ***A61H 3/00*** | (2006.01) |
| *A61H 3/02* | (2006.01) |

(52) U.S. Cl.

CPC ..... *A61G 5/14* (2013.01); *A61H 3/00* (2013.01); *A61H 3/0277* (2013.01); *A61H 2003/0205* (2013.01); *A61H 2201/0192* (2013.01)

(58) Field of Classification Search

None

See application file for complete search history.

(56) References Cited

U.S. PATENT DOCUMENTS

| | | | | |
|---|---|---|---|---|
| 2,757,388 A | | 8/1956 | Chisholm | |
| 3,553,746 A | | 1/1971 | Seiger | |
| 3,591,874 A | | 7/1971 | O'Kennedy | |
| 4,274,430 A | * | 6/1981 | Schaaf | A45B 3/00 135/65 |
| 4,314,576 A | * | 2/1982 | McGee | A61F 5/0104 135/67 |
| 4,474,202 A | | 10/1984 | Blechner | |
| 4,510,957 A | | 4/1985 | Frank | |
| 4,765,355 A | | 8/1988 | Kent | |
| 4,800,910 A | | 1/1989 | Gamm | |
| 4,843,661 A | | 7/1989 | Skibinski | |
| 4,884,587 A | * | 12/1989 | Mungons | A61H 3/00 135/65 |
| 4,922,560 A | | 5/1990 | Skibinski | |

(Continued)

FOREIGN PATENT DOCUMENTS

| | | |
|---|---|---|
| EP | 1809229 A2 | 7/2007 |
| WO | 2006/052778 A2 | 5/2006 |

*Primary Examiner* — David R Dunn

*Assistant Examiner* — Danielle Jackson

(74) *Attorney, Agent, or Firm* — Thompson Coburn LLP

(57) ABSTRACT

A walker standing aid accessory package consists of a lower attachment and an upper attachment. The lower foot bar piece allows the caregiver to utilize body weight to pin the walker's front legs to the floor or ground surface securely. The upper part incorporates multiple hand placement stabilization choices for both the patient and the caregiver. This invention increases patient's self help and reduces most of the caregiver's exertion. Once the patient is standing upright, the caregiver may step aside and monitor said patients immediate ambulation. The accessory package converts an existing walker into a device that not only helps the patient to stand but also reduces the strain on the caregiver. The walker with the accessories installed offers no interference or compromise to the existing walker's integrity, mobility or storage.

18 Claims, 7 Drawing Sheets

(56) References Cited

U.S. PATENT DOCUMENTS

| | | | | |
|---|---|---|---|---|
| 4,985,947 | A | 1/1991 | Ethridge | |
| 4,987,912 | A | 1/1991 | Taylor | |
| 5,005,599 | A | 4/1991 | Cunningham | |
| 5,347,666 | A | 9/1994 | Kippes | |
| 5,657,783 | A * | 8/1997 | Sisko | A61H 3/00 135/66 |
| 5,794,284 | A | 8/1998 | Southwell, Jr. et al. | |
| 5,853,015 | A | 12/1998 | Evans | |
| 5,983,911 | A | 11/1999 | Steele | |
| 6,044,507 | A * | 4/2000 | Smith | A61G 7/1038 248/158 |
| 6,170,501 | B1 | 1/2001 | Cook et al. | |
| 6,244,265 | B1 | 6/2001 | Cronk et al. | |
| 6,467,797 | B1 | 10/2002 | Lofy et al. | |
| 7,363,931 | B2 | 4/2008 | Weaver | |
| 7,377,285 | B2 | 5/2008 | Karasin et al. | |
| 8,166,987 | B2 | 5/2012 | Weaver | |
| 8,714,171 | B1 | 5/2014 | Haygood | |
| 8,726,922 | B2 * | 5/2014 | Pak | A61H 3/00 135/67 |
| 2002/0179131 | A1 * | 12/2002 | Johnson | A61H 3/00 135/66 |
| 2003/0151232 | A1 * | 8/2003 | Li | A61G 5/08 280/648 |
| 2009/0301533 | A1 | 12/2009 | Caldwell | |
| 2011/0232665 | A1 * | 9/2011 | Barnett, Jr. | A45B 7/00 132/200 |
| 2014/0371038 | A1 * | 12/2014 | Markowitz | A63B 21/4035 482/123 |
| 2015/0090308 | A1 | 4/2015 | Bos et al. | |

* cited by examiner

WALKER STANDING AID ACCESSORY

BACKGROUND OF INVENTION

The present invention relates to a mobility aid accessory package which is applied to an already existent walker ambulation device framework.

It has been determined by study of prior art that many attempts have successfully accomplished the task of assistance to a person trying to move from a seated to a standing position.

It has been further determined through investigation and observation that once standing upright the individual is often unable to make transfer from one device to another, due to tripping hazards or patient instability.

The present invention overcomes this obstacle through an accessorizing method of applying specifically designed aid devices to the patient's already existent walker appliance. This invention also aids the caregiver in that the caregiver can use the caregiver's body weight and minimal physical exertion to assist the patient. Once standing, the patient is then able to begin ambulation immediately. This invention also works in reverse when the patient needs to be seated.

The accessorizing method adds little weight to a walker and the walker may still be folded closed and immediately transported with the person or patient to the next needed location.

SUMMARY OF INVENTION

Many types and configurations of personal assisting devices are known. Most devices are able to assist patients with rising from a seated to standing position. However, in most cases the devices are stand alone and do not allow the patient or person ambulation. There then becomes a need in those cases for transference to some other conveyance.

The accessories herein described not only overcome much of the difficulty that a person experiences when trying to stand, but also aid the caregiver in helping the patient/person to a standing position using the caregiver's own weight applied to the foot bar, as a counter balance along with hand stabilization applied to the top piece. The caregiver exerts little physical effort during this maneuver. The same walker that was utilized for assistance is then already in position for the person's or patients immediate ambulation.

The accessory (Lower and Upper Units) work together for the combined purpose of assistance in rising, as well as sitting back down. The accessories do not interfere with patient/person motion and are away from any path that would result in a tripping hazard during ambulation.

Incorporation of the foot bar works to counteract tipping motion of the walker and the hand grip locations at the top of the walker allow choices for both the patient/person or the caregiver for needed hand placement.

Once the patient/person is upright and stable, the caregiver moves away and the walker is allowed to function and provide support as per its originally intended design.

The accessory package does not compromise any of the existing walker's integrity and requires no walker modification. All accessories are clamped to or slip mounted to the existing walker framework. With the accessories installed, the walker experiences a very small amount of added weight and still may be folded closed or opened as per its original design.

BRIEF DESCRIPTIONS OF THE DRAWINGS

Figure 1:
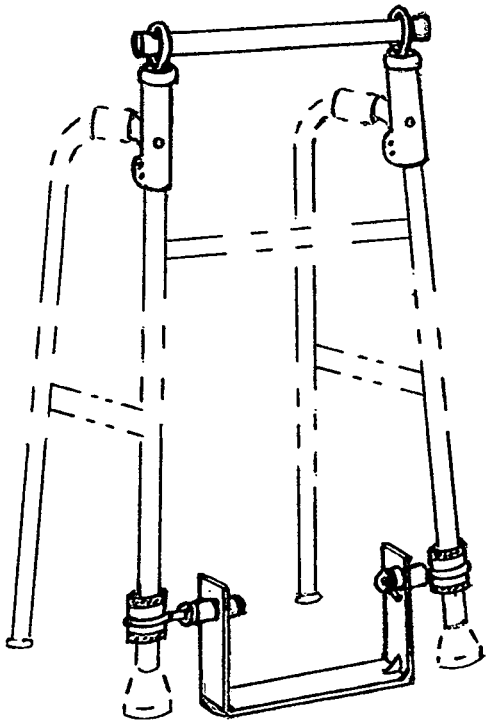
FIG. 1 is a perspective view of upper and lower accessory package installed on an existing walker (the walker being shown in phantom) with numbers removed.
Figure 2:
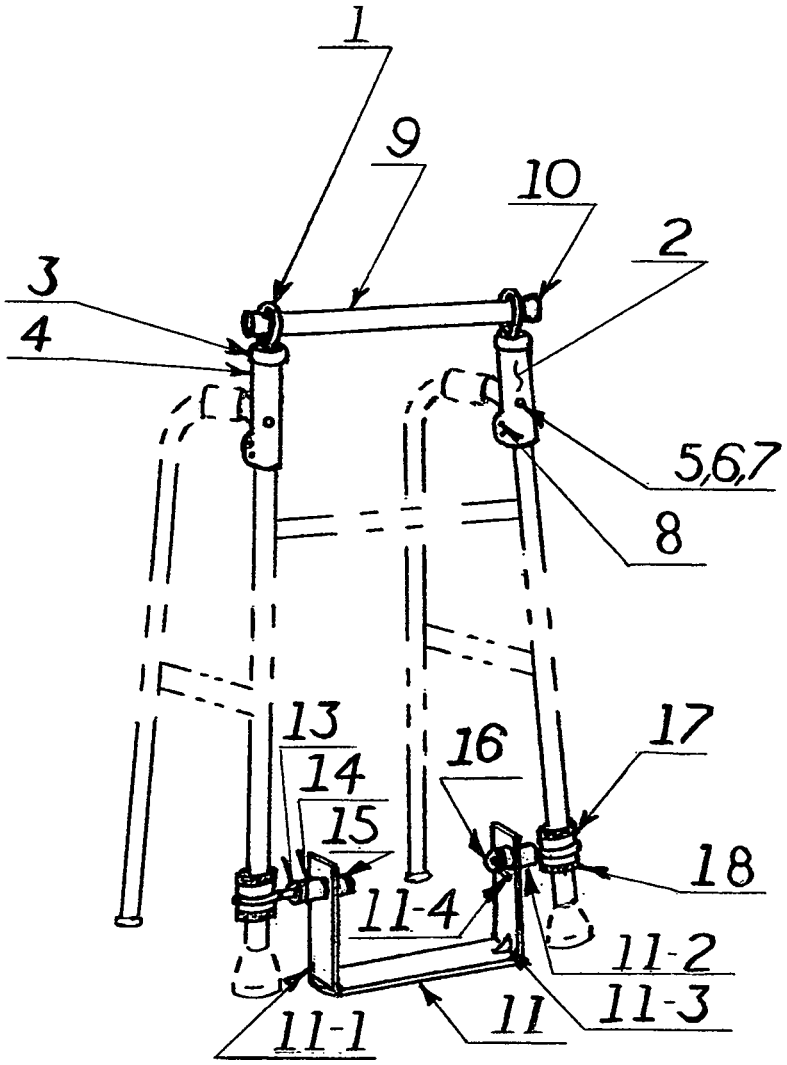
FIG. 2 is a perspective view of upper and lower accessory package installed on an existing walker (the walker being shown in phantom) with numbers assigned.
Figure 3:
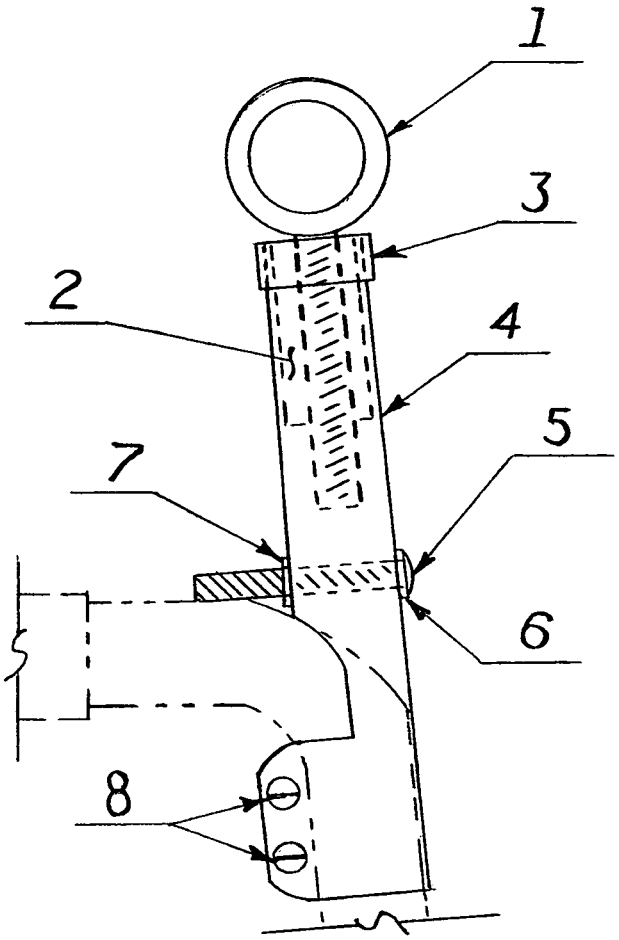
FIG. 3 is a view of an upright piece installed on a walker framework (the walker being shown in phantom).
Figure 4:
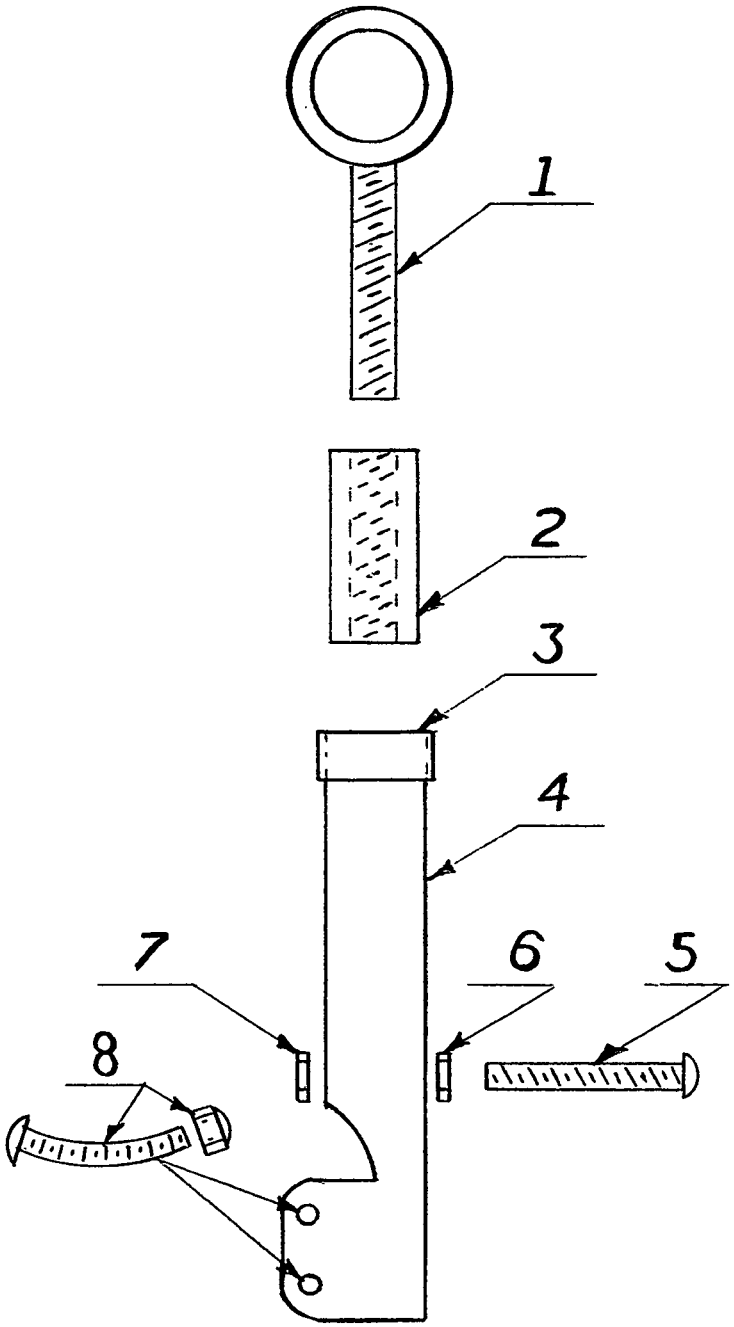
FIG. 4 is an exploded view of the upright piece of FIG. 3.
Figure 5:
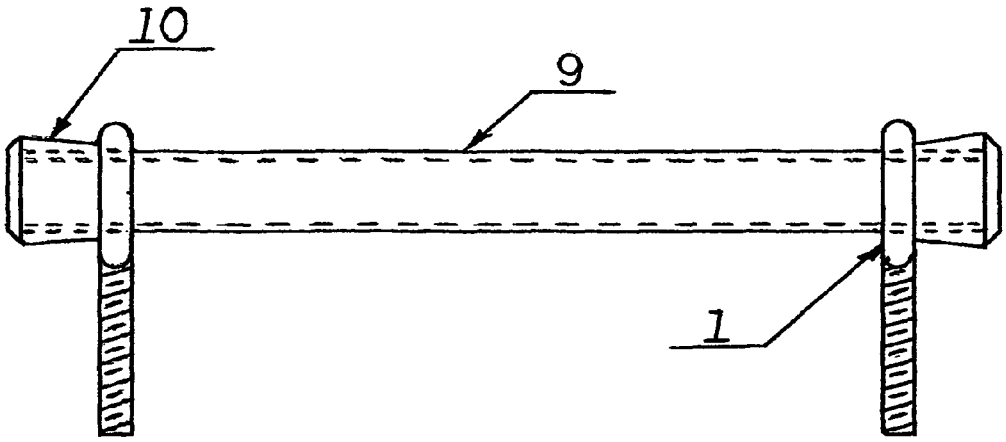
FIG. 5 is a view of a round tubular crossbar piece positioned in eyelet bolts of the upright pieces of FIG. 3.
Figure 6:
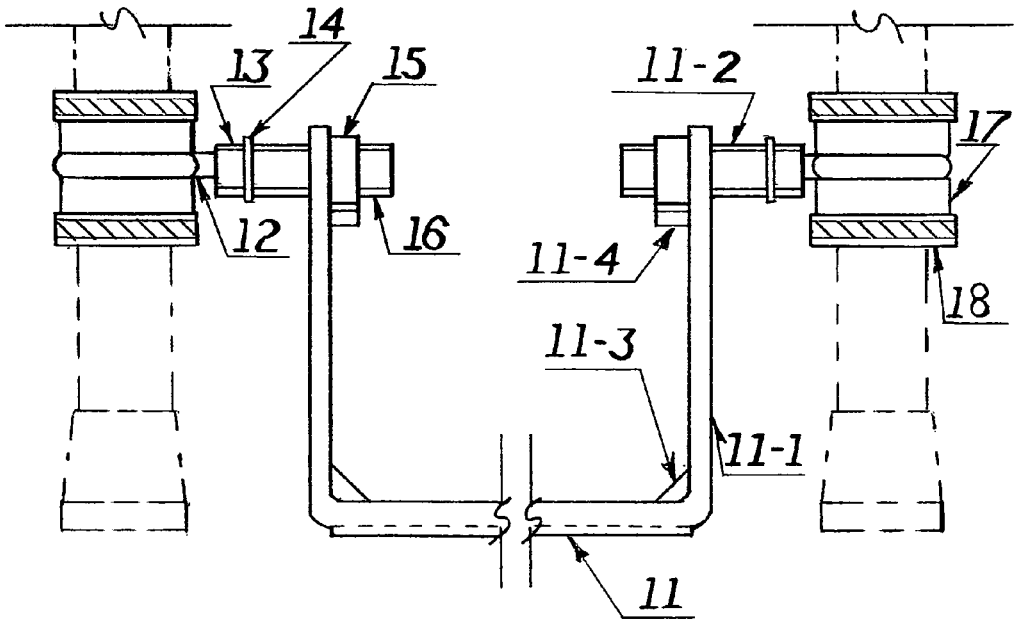
FIG. 6 is a view of a foot bar piece installed on lower front legs of an existing walker (the walker being shown in phantom).
Figure 7:
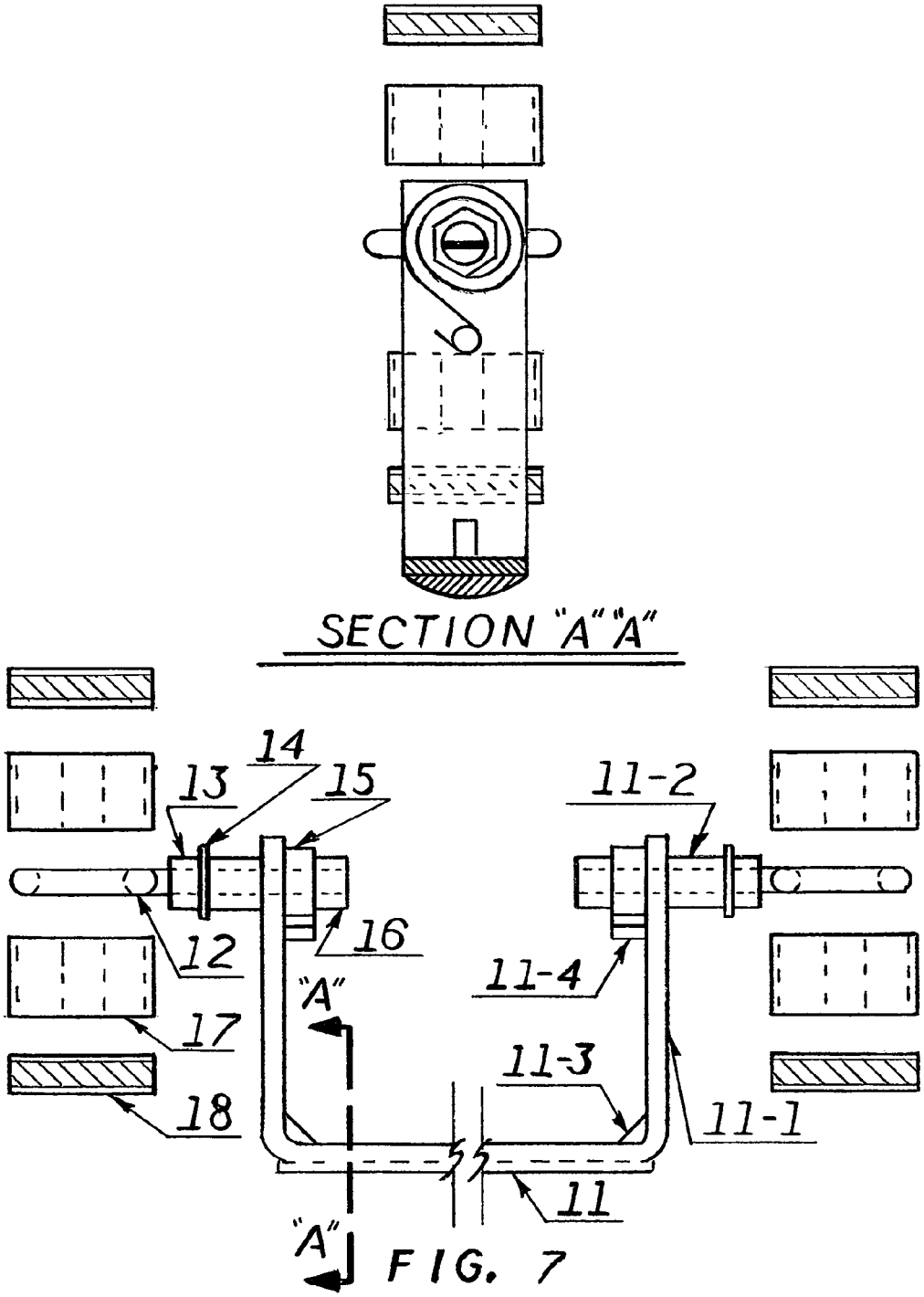
FIG. 7 is an exploded view and sectional view of the foot bar piece of FIG. 6.

PLEASE REFER TO DRAWINGS THAT FOLLOW.

DETAILED DESCRIPTION OF THE INVENTION

The prior art offers many aids and solutions to lessen the hardship that handicapped persons suffer while trying to stand, sit or ambulate. The hardship is extended to the caregiver when additional assistance is required.

The present invention is an accessory package designed to be installed on and to increase the capability of an existent walker appliance. The prior art has revealed many stand alone appliances. Accessorizing as is herein described has not been identified in prior art.

The installed walker standing aid accessory package affords the caregiver the ability to assist someone to stand or sit with little caregiver exertion. This is accomplished by the accessory foot bar piece and the accessory upright pieces.

The caregiver applies pressure with one foot to the foot bar. The foot bar has a rotation action incorporated therewith. Said rotation allows the base of the foot bar to rotate forward toward the caregiver and to make contact with the floor or ground surface. This locks the walkers front legs to the floor and prevents forward, backward or lateral motion. Additionally, the caregiver utilizes the top-part-installed accessories to further stabilize the walker by grasping the top crossbar or the upright supports.

Once the caregiver stabilizes the walker, the patient may grasp the existing walker framework of the patient's choice, for instance, the upright pieces, the top crossbar or using any combination thereof.

As the patient pulls his or herself upward, the caregiver acts as an counter opposing force.

The same method may be utilized in reverse to allow the patient to seat his or herself.

Once the patient is in the standing position, the caregiver releases the caregiver's grasp of the top accessory area and the caregiver's foot from the foot bar.

The foot bar automatically rotates back up to its original position away from the floor surface. The walker is now ready to allow the patient immediate ambulation.

There is no need for transfer to any other appliance and tripping hazards are eliminated due to the location of the accessory placement.

The following elemental descriptions explain in detail each component numerically identified in the previous drawing illustrations.

A threaded eye bolt (1) provides support for both ends (Left and Right) of a crossbar piece (9). The threaded portion of the eye bolt (1) is screwed down into a threaded insert (2). The threaded length of the insert (2) provides allowance for height adjustment and swivel rotation. Said rotation accommodates the opening and closing of the walker while maintaining the appliance attachment.

The threaded insert (2) is fitted permanently in the top portion of the left and right upright pieces (4). The insert provides the mounting location for the threaded eye bolt (1).

Protective caps (3) are incorporated to provide safety and hand comfort for the user or caregiver and secure the cross bar (9) in place.

(4) provides vertical hand grip support along with a mounting location for the crossbar piece. The upright pieces are bolted or clamped to the left and right upper frontal area of an existing walker. The composition may be metallic or composite. The lower portion of the upright piece is contour fabricated to allow full surface contact with the walker framework. The upright piece is also predrilled clear through to receive a bracing bolt (5) which further supports the upright piece (4).

The brace support bolt (5) includes a brace support bolt adjusting nut (6) and brace support bolt lock nut (7). The bracing bolt (5) extends through the drilled hole at the lower portion of the upright piece (4) and is adjusted to make contact with the upper tubular portion at left and right sides of the walker framework. The bracing bolt (5) is then locked in place and helps counter act any pulling force applied to the upright or crossbar pieces.

The brace support bolt adjusting nut (6) is described above.

The brace support bolt lock nut (7) is described above.

The upright piece clamping bolts (8) affix the upright pieces (4) to the left and right side of the frontal upper portion of the existing walker. The upright pieces (4) are slipped onto the upper portion of the existing walker left and right sides. Once in place the clamping bolts (8) hold the upright pieces (4) securely to the walker framework. In lieu of bolts (8), the upright pieces (4) may be bolted to the walker at the same location but permission must be given for breaching or drilling the existing walker framework.

The crossbar piece (9) is round/tubular in construction and is fabricated from either metallic or composite materials. The crossbar piece provides a connection between the left and right upright pieces (4). The crossbar piece passes through the eyelet portion of the eyelet bolts (1) and is locked in place by crossbar piece protective locking caps (10). The crossbar piece provides the assisted person or the caregiver a horizontal hand placement location. The pulling motion on either the horizontal crossbar piece (9) or the vertical upright piece (4) is counter acted by the opposing force of the care givers hand placement along with the locking of the footbar piece to the floor surface provided by the caregiver. Said locking of the footbar piece to the floor surface will be explained hereafter.

Protective locking caps (10) are described above.

The footbar piece (11) is attached to the lower frontal legs area of an existing walker. Said foot bar piece (11) is fabricated of either metallic or composite materials or combination thereof.

The foot bar piece (11) and cross bar piece (9) are used in conjunction by the caregiver. The caregiver places his or her foot on the foot bar piece when assisting a seated person to stand. The body weight of the caregiver pins the front legs of the walker to the floor or ground surface via the foot bar piece. This pinning arrangement provides a counteracting force when the patient/person utilizes the top portion to pull against while trying to rise from a seated position. This greatly decreases the strength normally required from the caregiver to assist the patient. When not in use the foot bar piece (11) rotates back upward.

Once the patient or person is upright and safely standing, the caregiver steps away from the front of the walker and the person then utilizes the walker as originally intended for ambulation.

With reference to the foot bar piece (11), the lowest part of foot bar piece (11) is fabricated flat on the top side and curved on the floor surface contact side. This configuration allows the foot bar piece (11) to smoothly release contact with the floor surface when caregiver foot pressure is removed. The footbar piece (11) includes left and right drop down suspensions (11-1) allowing adequate height to connect the foot bar piece to the walker leg framework at an elevated location that does not interfere with walker wheels, glides etc. The elongated nuts (11-2) are permanently affixed to drop downs (11-1) at the top locations. Said nuts allow the drop downs (11-1) to receive threaded eyelet bolts (12). The combination of threaded nuts and threaded eyelet bolts provide the necessary pivoting locations (upward and downward) for foot bar piece (11). The torsion spring mounting post (11-4) is permanently affixed to an upper location of the drop down suspensions (11-1). The torsion spring mounting post (11-4) receives the outermost end of torsion springs (15).

With further reference to drop down suspensions (11-1), said drop down suspensions are drilled clear through to allow the threaded portions of the eyelet bolts (12) to extend through the upper portion of drop downs (11-1).

With further reference to the foot bar piece (11), reinforcing gussets (11-3) help reduce flexing action between the foot bar lower part and the drop down suspensions (11-1).

With further reference to foot bar piece (11), the foot bar piece (11) has left and right top portion eyelet bolts (12). Said eyelet bolts allow the foot bar piece to be mounted on an existing walker's frontal area near the base. Said eyelet bolts provide a rigid support for the foot bar piece (11) while simultaneously allowing frontal walker legs to rotate therein approximately ninety degrees. Said rotation accommodates the opening and closing of walker framework without removal of foot bar piece (11). The eyelet bolts (12) are fabricated with a slotted thread arrangement. Said slot provides the necessary mounting for the center portion of torsion springs (15). Said torsion springs allow the foot bar piece (11) to return to the upright position once the caregiver's foot pressure has been removed. Once the footbar piece is rotated back to its up position, the torsion spring (15) holds the foot bar piece (11) upward and away from the path of ambulation.

With further reference to the eyelet bolts (12), the eyelet bolts (12) provide the necessary mounting for stop nuts (13), a spacer (14), torsion springs (15), and a locking cap nut (16). The stop nuts (13) provide both upward and downward travel limitation for the foot bar piece (11). The spacer (14) provides a separation with slippage between the stop nuts (13) and the elongated nuts (11-2). The torsion spring (15) allows the foot bar piece to automatically return to the upright position when the caregiver's foot is removed from the foot bar piece (11). The above described assembly is secured in place by the locking cap nuts (16).

With further reference to foot bar piece (11) and the eyelet bolts (12), the foot bar piece makes contact with walker leg framework at the bolt eyelet location. The eyelet bolts on the left and right sides are supported via top and bottom support sleeves (17). Said support sleeves slide onto and tightly grip the existing walker legs on both left and right sides. The eyelet bolts (12) rest on lower support sleeves on both left and right sides while the upper support sleeves help provide proper alignment and rigidity. Additionally, the support sleeves are slotted vertically top to bottom in order to accommodate the walker leg adjusting pins. The walker may then be height adjusted with the foot bar assembly (11) installed.

With further reference to the top and bottom support sleeves (17) said sleeves are securely held in place by compression clamps (18).

We claim:

1. A walker comprising:

a first lateral side having a front leg spaced from a rear leg, each of the first lateral side front and rear legs having a distal end configured to contact a support surface on which the walker is used, a first lateral side strut extending transversely between the first lateral side front and rear legs and spaced from the distal ends of the first lateral side front and rear legs;

a second lateral side spaced from the first lateral side, the second lateral side having a front leg spaced from a rear leg, each of the second lateral side front and rear legs having a distal end configured to contact a support surface on which the walker is used, a second lateral side strut extending transversely between the second lateral side front and rear legs and spaced from the distal ends of the second lateral side front and rear legs;

a hand grip extending from the first lateral side front leg adjacent to the first lateral side strut and a hand grip extending from the second lateral side front leg adjacent to the second lateral side strut;

a crossbar extending from the first lateral side adjacent to the first lateral side strut to the second lateral side adjacent to the second lateral side strut; and a foot bar with opposite first and second ends and a bearing surface extending between the first and second ends, the foot bar first end being operatively pivotally connected to the first lateral side front leg, the foot bar second end being operatively pivotally connected to the second lateral side front leg, the foot bar being pivotal between a retracted position in which the foot bar bearing surface is spaced from the support surface on which the walker is placed, and a deployed position in which the foot bar bearing surface moves parallel and adjacent to the support surface on which the walker is used; and wherein the foot bar first and second ends are pivotally connected to the respective first and second lateral sides with an eyelet portion to define a pivot axis offset from the foot bar bearing surface and extending in a direction from one lateral side of the walker to the opposite lateral side of the walker, the eyelet portion permitting relative rotary and linear movement between the eyelet portion and the respective first and second lateral sides of the frame, and wherein at least one collar slidingly fixes linear movement of the eyelet portion relative to a respective first and second lateral sides of the frame and permits rotary movement between the eyelet portion and the respective first and second lateral sides of the frame.

2. The walker of claim 1 wherein the crossbar is operatively pivotally connected to the respective first and second lateral sides thereby allowing the first and second lateral sides to pivot toward and away from each other.

3. The walker of claim 2 wherein the crossbar is operatively pivotally connected to the first and second lateral sides in a manner such that the pivotal connection is movable toward and away from the struts of the first and second lateral sides in a vertical direction relative to the support surface on which the walker is used.

4. The walker of claim 1 wherein the foot bar is operatively pivotally connected to the front legs of the first and second lateral sides with a biasing member that urges the foot bar to the retracted position.

5. The walker of claim 1 wherein the foot bar has reinforcement gussets at the first and second ends of the foot bar.

6. The walker of claim 1 wherein the foot bar is operatively pivotally connected to the first and second lateral sides in a manner such that the pivotal connection is pivotal about the front legs of the first and second lateral sides thereby allowing the first and second lateral sides to pivot toward and away from each other.

7. The walker of claim 1 wherein the foot bar is operatively pivotally connected to the first and second lateral sides in a manner such that the pivotal connection is movable toward and away from the struts of the first and second lateral sides in a vertical direction relative to the support surface on which the walker is used.

8. A walker comprising:

a frame with opposite lateral sides;

a cross bar having opposite first and second ends, the cross bar first and second ends operatively connected to respective opposite lateral sides of the frame; and a foot bar having first and second ends each operatively pivotally connected to respective opposite lateral sides of the frame about a foot bar pivot axis with an eyelet portion, the foot bar having a bearing surface extending between the first and second ends, the foot bar being pivotal about the foot bar pivot axis between a retracted position in which the foot bar bearing surface is spaced from a support surface on which the walker is placed, and a deployed position in which the foot bar bearing surface moves parallel and adjacent to the support surface on which the walker is placed, the foot bar pivot axis being offset from the foot bar bearing surface and extending in a direction from one lateral side of the walker to the opposite lateral side of the walker, the eyelet portion permitting relative rotary and linear movement between the eyelet portion and the respective lateral opposite of the frame, and wherein at least one collar slidingly fixes linear movement of the eyelet portion relative to a respective lateral opposite side of the frame and permits rotary movement between the eyelet portion and the respective lateral opposite of the frame.

9. The walker of claim 8, further comprising:

a first hand grip extending outward from the frame adjacent to the first end of the cross bar; and a second hand grip extending outward from the frame adjacent to the second end of the cross bar.

10. The walker of claim 8 wherein the first end of the foot bar has a first arm extending perpendicularly to the foot bar and the second end of the foot bar has a second arm extending perpendicularly to the foot bar.

11. The walker of claim 10 wherein the first and second arms of the foot bar have pivot connections with the respective lateral opposite sides of the frame at the foot bar pivot axis.

12. The walker of claim 8, wherein the first and second ends of the foot bar are operatively pivotally connected to the respective lateral opposite sides of the frame with a biasing member that urges the foot bar to the retracted position.

13. The walker of claim 8 wherein the foot bar is operatively pivotally connected to respective lateral opposite sides of the frame such that the pivotal connection is pivotal about an axis perpendicular to the foot bar pivot axis thereby allowing the lateral opposite sides of the frame to pivot toward and away from each other.

14. The walker of claim 8 wherein the foot bar is operatively pivotally connected to the respective lateral opposite sides of the frame such that the pivotal connection is movable along a vertical direction relative to the support surface on which the walker is used.

15. An accessory package for a walker, the accessory package comprising:

a foot bar having first and second ends and a bearing surface extending between the first and second ends; and first and second pivot connections configured to connect to respective first and second ends of the foot bar and respective laterally opposite sides of a frame of the walker, each of the pivot connections having a foot bar pivot axis about which the foot bar pivots when connected to the frame of the walker between a retracted position in which the foot bar bearing surface is spaced from a support surface on which the walker is placed, and a deployed position in which the foot bar bearing surface moves parallel and adjacent to the support surface on which the walker is placed, each of the first and second pivot connections having a foot bar attachment portion being configured for attachment to respective first and second ends of the foot bar, each of the first and second pivot connections having a walker attachment portion, the walker attachment portion being configured for attachment to opposite lateral sides of the walker, at least one of the pivot connections having a biasing member configured to urge the foot bar in a rotary direction about the foot bar pivot axis;

wherein the walker attachment portion of each of the pivot connections has an eyelet portion assembleable with a respective lateral opposite side of the frame, the eyelet portion permitting relative rotary and linear movement between the eyelet portion and the respective lateral opposite of the frame when assembled therewith, and at least one collar for fixing linear movement of the eyelet portion relative to a respective lateral opposite side of the frame and permitting rotary movement between the eyelet portion and the respective lateral opposite of the frame.

16. The accessory package of claim 15 wherein the foot bar has first and second arms extending perpendicularly from the respective first and second ends of the foot bar.

17. The accessory package of claim 15 wherein the walker attachment portion of each of the pivot connections is configured to be pivotally connected with a respective lateral opposite side of the frame about an axis perpendicular to the foot bar pivot axis.

18. The accessory package of claim 15 wherein the walker attachment portion of each of the pivot connections is configured to be slidingly connected with a respective lateral opposite side of the frame in a direction perpendicular to the foot bar pivot axis.

* * * * *